US005975483A

United States Patent [19]

Schüle

[11] Patent Number: 5,975,483

[45] Date of Patent: Nov. 2, 1999

[54] CLAMP WITH CLAMPING JAWS AND A CARRIER CONNECTING THEM

[75] Inventor: Josef Schüle, Steinach, Germany

[73] Assignee: Paschal-Werk G. Maier GmbH, Steinach, Germany

[21] Appl. No.: 09/236,053

[22] Filed: Jan. 22, 1999

Related U.S. Application Data

[63] Continuation of application No. PCT/EP97/03681, Jul. 11, 1997.

[30] Foreign Application Priority Data

Jul. 23, 1996 [DE] Germany ..... 196 29 660

[51] Int. Cl.[6] ..... E04G 17/04

[52] U.S. Cl. ..... 249/219.1; 249/44; 249/192; 269/218

[58] Field of Search ..... 249/219.1, 219.2, 249/207, 192, 193, 47, 195; 269/249, 41, 45, 228, 236, 87.1, 218, 217; 24/522

[56] References Cited

U.S. PATENT DOCUMENTS

| | | | |
|---|---|---|---|
| 1,423,162 | 7/1922 | Simpson | 249/219.1 |
| 2,610,660 | 9/1952 | Jennings et al. | 249/219.2 X |
| 3,071,368 | 1/1963 | Harding | 269/218 |
| 4,202,540 | 5/1980 | Neff | 269/236 X |
| 4,566,304 | 1/1986 | Van Cleave et al. | 269/236 X |
| 4,881,716 | 11/1989 | Dingler | 249/47 X |
| 5,146,816 | 9/1992 | Badstieber | 269/218 X |
| 5,368,272 | 11/1994 | Badstieber | 249/44 X |

FOREIGN PATENT DOCUMENTS

| | | | |
|---|---|---|---|
| 0 537 403 A1 | 4/1993 | European Pat. Off. . | |
| 1208214 | 9/1959 | France | 249/44 |
| 85 35 906 U | 5/1991 | Germany . | |
| 39 41 937 A1 | 6/1991 | Germany . | |
| 91 02 391 U | 6/1991 | Germany . | |
| 40 07 950 A1 | 9/1991 | Germany . | |
| 44 34 959 C1 | 5/1996 | Germany . | |

*Primary Examiner*—Dennis L. Taylor
*Attorney, Agent, or Firm*—Akin, Gump, Strauss, Hauer & Feld, L.L.P.

[57] ABSTRACT

A clamp (1) for connecting form panels disposed in coplanar, side-by-side relation which engages their edge webs (2) or edge sections, which webs (2) can be directly adjacent to each other or have an intermediate piece in between. In order to adapt to the varying spacings or to different dimensions of edge webs (2) or edge sections, the clamp includes a first swivelling clamping jaw (4) which is steplessly adjustable relative to a stationary clamping jaw (5) and lengthwise on a carrier (6) which supports the two clamping jaws (4 and 5). In addition, the first swivelling clamping jaw (4) is swivel-mounted on a slide (10) which, in turn, can be fixed by clamping in any position on the carrier (6), particularly by a tipping or swivel movement in an opposite direction. Therefore, the spacing between the clamping jaws (4 and 5) can be steplessly adjusted, without any measures for holding the swivel axis (9) of the swivelling clamping jaw (4) having to be taken on the carrier (6) itself, which could weaken the carrier (6).

10 Claims, 4 Drawing Sheets

CLAMP WITH CLAMPING JAWS AND A CARRIER CONNECTING THEM

CROSS REFERENCE TO RELATED APPLICATION

This application is a continuation of International Application PCT/EP97/03681, Filed Jul. 11, 1997.

BACKGROUND OF THE INVENTION

The invention relates to a clamp for connecting form panels which are disposed in coplanar, side-by-side relation and have edge webs or edge sections along at least two confronting edges, and preferably along all of the edges, whereby the clamp has two clamping jaws adapted to be urged against the oppositely directed longitudinal faces of the adjacent edge webs or edge sections, a carrier connecting the clamping jaws and an actuating element for swivelling the first clamping jaw, whereby the second clamping jaw is connected to the carrier at a fixed or invariable angle, preferably in a permanent fashion, and the first clamping jaw is slidable relative to, and in the longitudinal direction of, the carrier and in different positions of travel is adapted to swivel about an axis oriented transversely to the carrier by means of a wedge, eccentric or similar adjusting element.

A clamp of this general type is known, by way of example, from EP-0 537403 A. In that reference, the swivelling first clamping jaw has a bolt that traverses the carrier to form the swivel axis. Extending lengthwise of the carrier, at its back remote from the clamping jaws, is a slot which serves for guidance of a wedge element arranged there. In addition, further slots are provided in the side faces of the carrier which are arranged at right angles to the back. Such slots have a toothing on the side which comes under pressure from the joint of the first clamping jaw when the clamp is tightened and the bolt serving as the swivel axis can be selectively inserted in the tooth spaces. Therefore the first clamping jaw can be adjusted into different positions only stepwise according to the tooth spacing. The user hence has to predetermine precisely in which of the possible positions the clamping jaw will exert its optimal clamping force. Since for the purposes of horizontal adjustment, it may perhaps be necessary for intermediate pieces of different sizes to be placed between two edge sections of adjacent form panels, the outsides of the edge sections may come to be at a spacing for which none of the fixed tooth positions of the swivelling clamping jaw is best for an optimal transfer of clamping force.

The wedge arranged at the back of the carrier for swivelling the first clamping jaw engages behind a transverse bolt which connects the two parallel portions of this clamping jaw and is arranged in spaced relationship to the swivel axis of the clamping jaw, so that a corresponding lever arm is produced.

Apart from the fact that with this known clamp the first clamping jaw can be adjusted only stepwise, high friction forces and cramming forces are induced during its swivel movement by the wedge inserted between the back and this bolt belonging to the clamping jaw. Therefore the user cannot be sure that, given a tight fit of the wedge, the maximum clamping force really is generated. Furthermore, a special wedge is necessary which requires appropriate guide means for engagement with the longitudinal guide at the back of the carrier. It hence follows that, all in all, production is complicated, also as a result of the toothing.

During the swivel movement, due to the force component oriented approximately at right angles to the carrier, the swivel bearing is subjected to ever increasing pressure in this arrangement, so that the frictional forces in this bearing increase. At least part of the forces applied by the wedge is hence used within the bearing and is not available as clamping force.

SUMMARY OF THE INVENTION

The object underlying the invention is therefore to provide a clamp of the kind set forth at the outset, wherein the adjusting forces on the clamping jaw are to a very large extent available for its swivel movement and thus for the clamping force and wherein, above all, a toothing within the adjusting area is avoided. At the same time, optimal adaptation of the movable and swivelling clamping jaw to different spacings between the longitudinal faces of the adjacent edge webs or edge sections or compensating elements arranged therebetween is possible.

To accomplish this apparently contradictory objective, the clamp of the type set forth at the outset is characterized in that the swivelling first clamping jaw is swivel-mounted on a slide which is steplessly adjustable relative to the carrier, and the slide is disengageably fixable on the carrier by clamping in any position of travel.

In this manner, the adjusting forces in the longitudinal direction of the carrier are exerted substantially upon the slide which, in an advantageous fashion, can be clamped to the carrier in any position. This results in stepless adaptation to different dimensions, hence the two clamping jaws are steplessly adjustable in their spacing. The swivelling clamping jaw can then in turn be swivelled relative to this slide, so that the clamping to the carrier does not have to influence this swivel movement. In this manner, toothing to receive the swivel bearing of the clamping jaw can be avoided. Hence considerable advantages follow from the apparent extra expenditure involved by the arrangement of the swivel bearing of the clamping jaw on a slide steplessly adjustable relative to the carrier. Furthermore, the complicated arrangement of a toothed slot with a plurality of points of support usable stepwise for the swivelling clamping jaw can be avoided.

It is advantageous in this connection if the slide projects at least partially projects beyond the first clamping jaw swivel-mounted on it and does so spaced from the swivel axis so as to form a lever arm and if an opening for a wedge or a bearing for an eccentric is provided at this projecting area, which wedge or eccentric or similar adjusting element has its wedge face or eccentric face applied to the swivelling clamping jaw. Therefore the swivel movement of the clamping jaw relative to the slide can be generated using a very simple adjusting element, preferably a wedge that is generally commercially available.

The swivelling clamping jaw can take the form of a double armed lever whose one arm in the position of use transmits the clamping force and whose other arm, as the actuating arm, projects beyond the swivel bearing to the opposite side, and the wedge or eccentric can be applied to this actuating arm. Therefore, the force exerted by the wedge or eccentric can be applied largely with a lever arm relative to the swivel bearing, so that it does not at the same time have to appreciably increase the pressure within the swivel bearing. The swivel movement with the aid of the wedge or eccentric can be carried out correspondingly smoothly.

In an advantageous embodiment of the invention, the slide has a guiding part sidable on the carrier, and a holding part capable of swivelling relative to this guiding part, which holding part engages over the carrier with an abutment on the side which is remote from the guiding part and is the side on which the clamping jaws project from the carrier, and that the distance between the guiding part and the abutment which belongs to the holding part and engages over the carrier is greater than the cross-sectional size of the carrier in this direction. As a result, a swivel movement of the holding part relative to the carrier leads to the abutment bearing clampingly against the carrier on the side remote from the guiding part. Hence the slide embracing the carrier has overall a larger inner width than corresponds to the cross-sectional size of the carrier, and hence can be swivelled slightly relative to the carrier. If the plane spanned by the slide coincides with a cross-sectional plane of the carrier, the slide can thus be smoothly slid relative to the carrier and assume any steplessly adjustable position. There it can be effectively clamped to the carrier by tipping slightly about an axis extending transversely of the carrier. This tipping in the desired position of use ensues practically automatically by putting the adjusting element on the swivelling clamping jaw into use. This is so, because the clamping jaw, in turn, is swivel-mounted on the slide, so that the force component developing approximately in the direction of the orientation of the carrier by the swivel movement of the clamping jaw also leads to the slide tipping and clamping. The arrangement according to the invention of a slide as adjusting element and mount of the clamping jaw capable of swivelling relative to the slide hence also leads to advantageous handling of the clamp.

For a more or less automatic clamping of the slide in a preselected position and for swivel movement of the first clamping jaw by the adjustment of the adjusting element, i.e. a wedge or eccentric, it is advantageous if the distance between the swivel axis of the swivelling clamping jaw on the holding portion of the slide and the abutment of the slide is smaller than the distance between the swivel bearing of the slide and the abutment, and if the wedge opening or the bearing of the eccentric is provided in the guiding part.

Then different lever arms are obtained with which the wedge or eccentric is applied to the respective swivel axes, so that a relatively high clamping force can be generated with a correspondingly great lever arm particularly after the slide has been jammed.

Further developments of the clamp according to the invention are recited in the claims.

In one particularly advantageous arrangement, a wedge is disposed in and is movable in an opening with a wedge-shaped taper in the guiding part to serve as actuating element for swivel movement.

In another advantageous arrangement, the swivelling clamping jaw can be composed of two interconnected parts. This is to permit the carrier and above all the holding part of the slide to be embraced on both sides, so that the swivel movement and the clamping force can be applied substantially symmetrically to the carrier. Further, the carrier then does not need any openings for parts capable of adjustment or swivel movement relative to it, especially since through the swivel bearing of the first clamping jaw on the holding part a corresponding bearing opening in the carrier is already avoided.

In another advantageous arrangement, a suitable configuration of the cross section of the carrier and of the guiding part of the slide movable relative thereto is provided in which the carrier has a T-shaped cross-section and the T-crosspiece carrys the stationary clamping yarn and the swiveling clamping jaw engages over the T-crosspiece. The guiding part requires only a guiding groove which engages the narrow side of the main web of the T-section which receives the edge of the main web.

In another possible configuration of the invention, the swivel bearing of the holding part of the slide is arranged such that it is not capable of swivelling in unison relative to the guiding part. As the holding part can swivel relative to the guiding part, the entire slide need not be swivelled, so that the guiding part can have a length sufficient for good and stable guidance, retaining the guide function in practically every position of the holding part. This is provided by the swivel bearing of the holding part being arranged at an open ended recess of the guiding part which takes the form of a bolt inserted in the recess. The recess is open toward the side facing away from the clamping jaws and the bolt extends transversely to and crosses the carrier.

In another aspect of the invention, there exists the possibility of on the one hand the wedge for performing the swivel movement of the first clamping jaw, and on the other hand the slide or its guiding part, being captive on the clamp. This is provided by the travel of the slide or the guiding part thereof and/or the movement of the wedge in the open position being limited by a projection or an enlarged cross section.

Particularly when the features and measures described above and included in the claims are combined singly or severally, a clamp ensues in which the swivelling clamping jaw is not mounted directly on the carrier, but on a slide which is steplessly movable relative to the carrier and is adapted to be clamped in any position. As a result, advantageous conditions of support and transfer of force are obtained and not only the handling, but also the production and assembly of the clamp are simple, despite this indirect mounting of the swivelling clamping jaw on the carrier.

An exemplary embodiment of the invention will be described in greater detail below with reference to the drawings.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings, which are partly in schematic form.

DETAILED DESCRIPTION OF THE INVENTION

Figure 1:
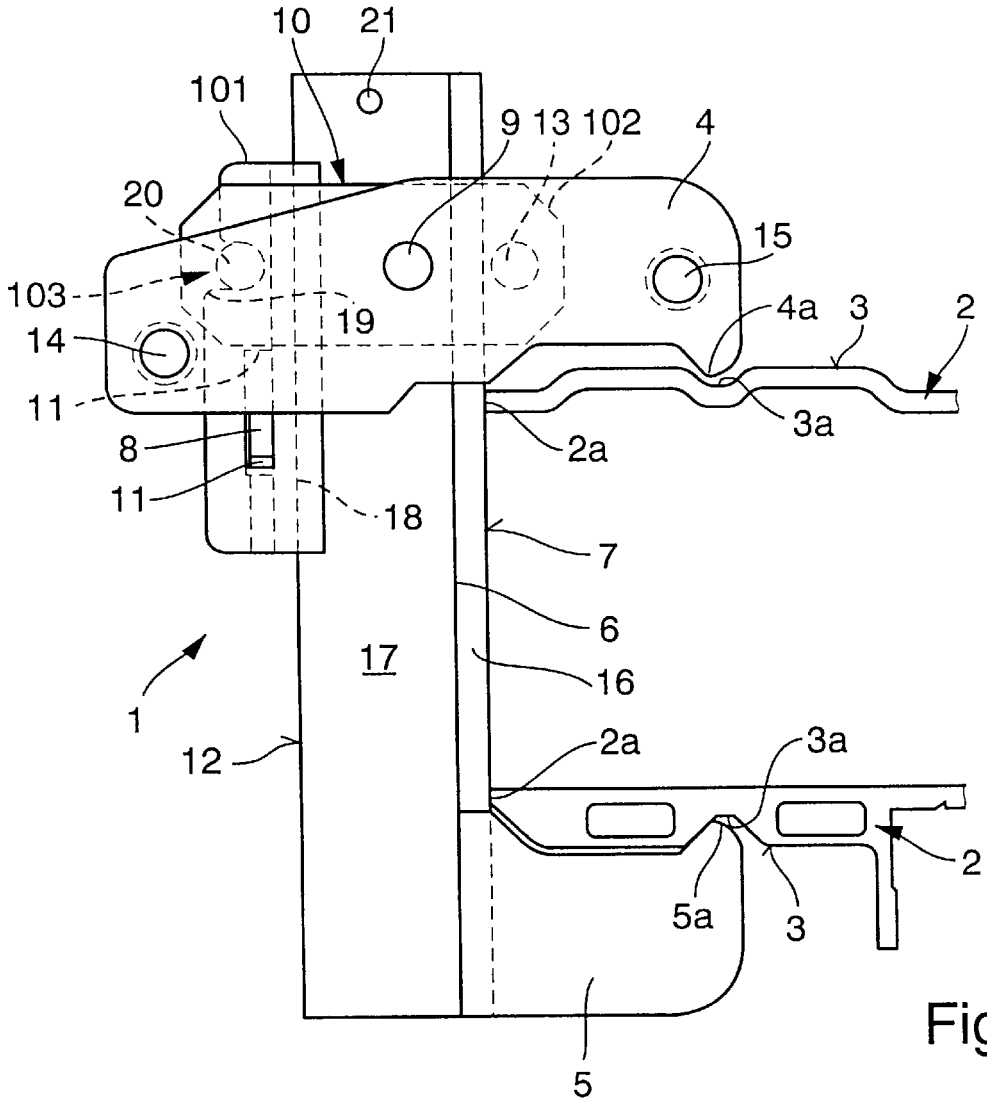
FIG. 1 is a representation of the clamp according to the invention in an open position, with the viewing direction onto the end faces of the edge webs for connection of adjacent form panels.

A clamp, generally designated 1, serves for connecting form panels which are disposed in coplanar, side-by-side relation. For simplicity's sake, the exemplary embodiment shows the form panels only in respect of their edge webs 2 or edge sections which are arranged at the confronting edges and are to be fastened to each other with the aid of the clamp 1. In the exemplary embodiment, a space for receiving squared timber or the like is left between these edge webs 2 which may, for example, also differ in configuration.

The clamp 1 has two clamping jaws 4 and 5 adapted to be urged against the oppositely directed longitudinal faces 3 of the edge webs 2 to be fastened to each other. As already mentioned, this fastening of the edge webs 2 to each other can also be done with squared timber or a similar intermediate piece disposed between them. The edge webs 2 can, however, also be directly adjacent to each other and be fixed in such a position with the aid of the clamp 1.

The clamp 1 has a carrier 6 which connects the clamping jaws 4 and 5 and extends in the direction in which the clamping force acts in the position of use. This carrier 6 also serves for mutual alignment of the edge webs 2 whose free edges 2*a* bear against the front side 7 of this carrier 6 in the position of use.

A first clamping jaw 4 of the clamp 1 is capable of swivelling relative to the carrier 6, in a manner yet to be described, with the aid of an actuating element which, in the exemplary embodiment, is preferably provided with the aid of a wedge 8. The second clamping jaw 5 forms a fixed or invariable angle together with the carrier 6 and is also connected to the carrier 6 in a permanent fashion. The clamping force is therefore to be applied by the movement of the first clamping jaw 4, while the second clamping jaw 5 then generates the corresponding counterforce as reaction force.

For adaptation to edge webs 2 or edge sections differing in dimension or to different intermediate pieces and thus different spacings of these edge webs or edge sections 2, the movable first clamping jaw 4 is capable not only of swivelling, but also of sliding relative to, and in the longitudinal direction of the carrier 6. In different positions of travel, the movable first clamping jaw 4 can be swivelled by means of the already mentioned wedge 8, in a manner yet to be described, about an axis 9 oriented transversely of the carrier 6, namely, against the outer longitudinal face 3 of the edge web 2 so as thereby to generate the clamping force wanted. In a known manner, the clamping jaws 4 and 5 have projections 4*a* and 5*a* respectively, which engage with corresponding depressions 3*a* in the longitudinal faces 3 of the edge webs 2 or edge sections and by this means also deflect part of the clamping force toward the carrier 6 to improve the alignment of the edges 2*a* at the front side 7 of the carrier 6.

Figure 2:
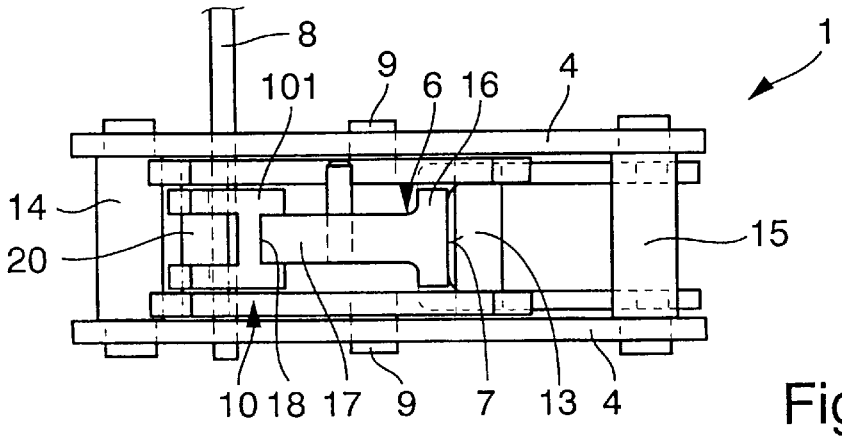
FIG. 2 is a front view of the clamp of FIG. 1, the viewing direction corresponding to the direction in which the carrier of the clamping jaws of this clamp extends.
Figure 3:
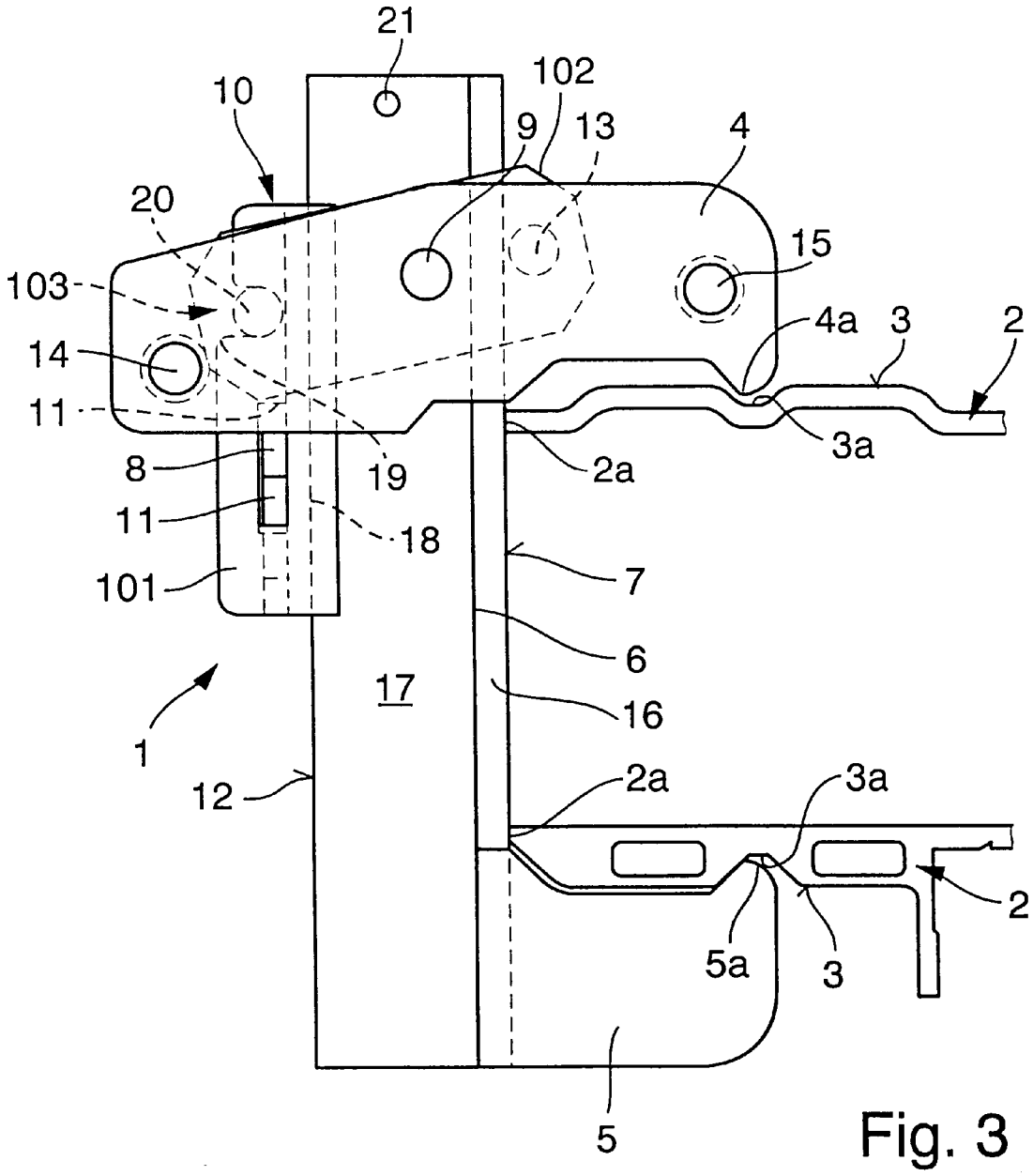
FIG. 3 is a representation corresponding to that of FIG. 1, wherein the slide which carries the swivelling first clamping jaw by way of a swivel bearing and is for its part capable of swivelling or tipping is jammed or clamped to the carrier by a swivel movement relative thereto.
Figure 4:
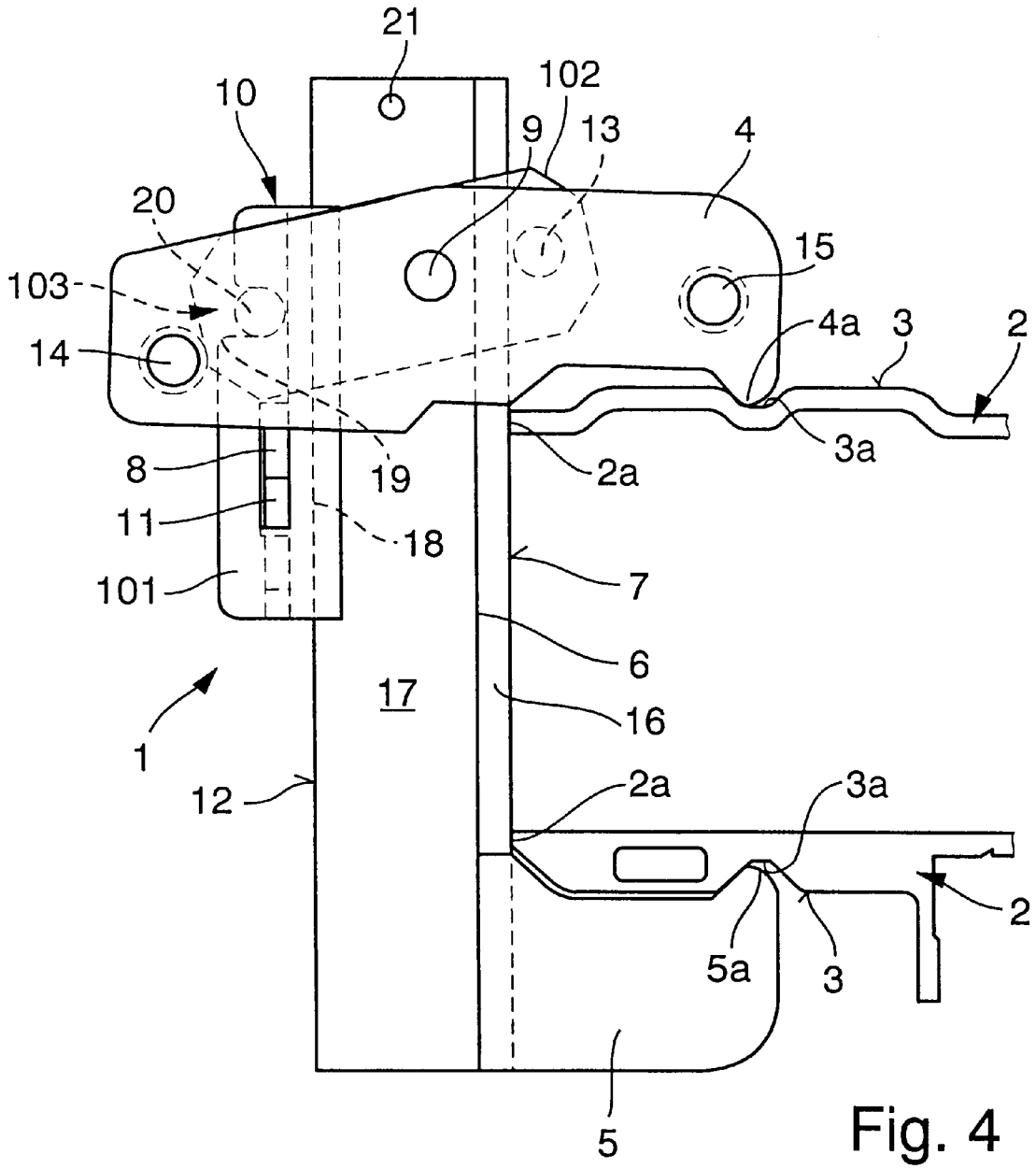
FIG. 4 is a representation corresponding to that of FIG. 3, wherein the swivelling first clamping jaw is swivelled relative to the clamped or jammed slide to assume the use position or clamping position.
Figure 5:
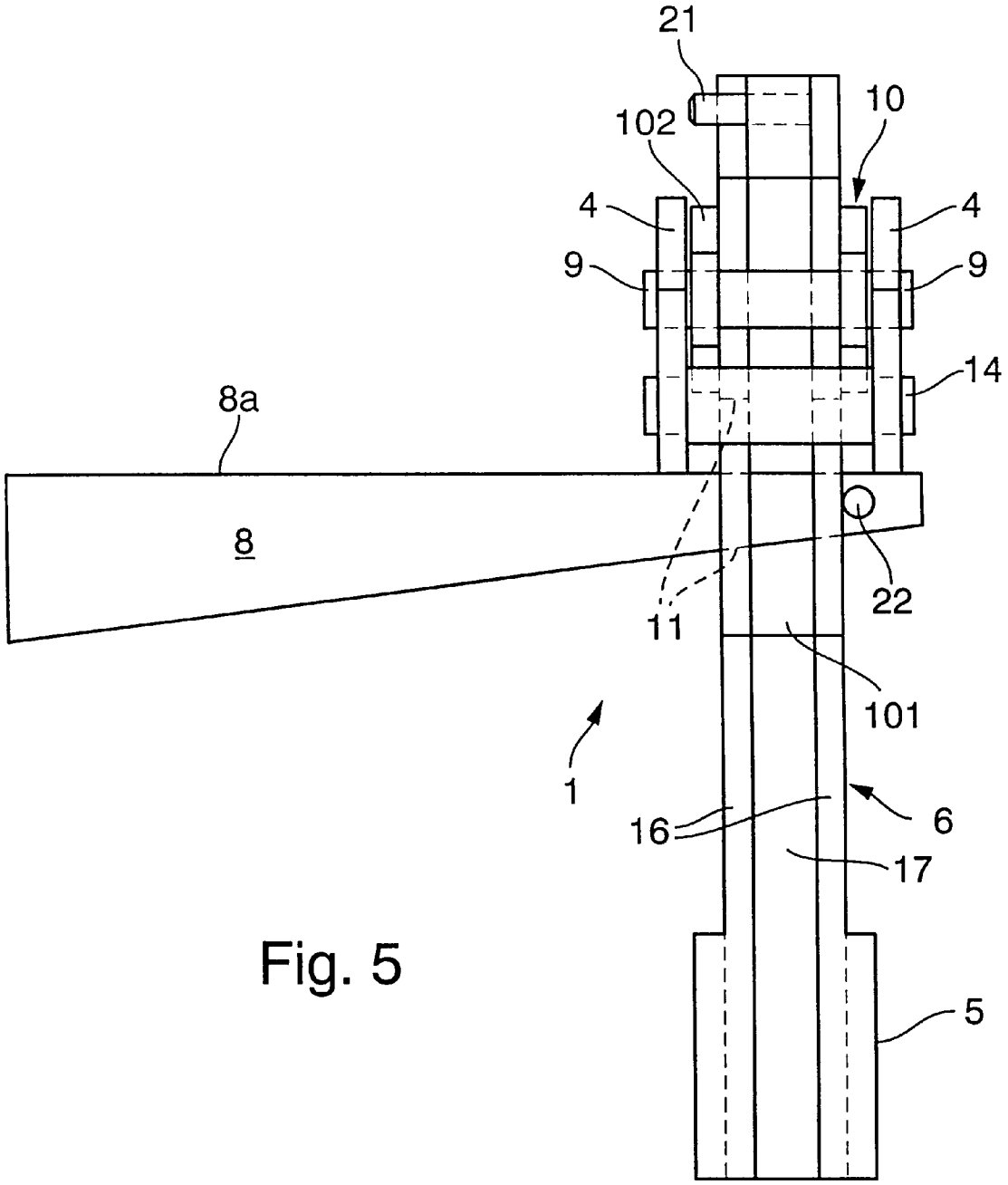
FIG. 5 is a view of the back of the clamp according to the invention in the disengaged or opened position.

Particularly in looking at FIGS. 1, 2 and 5 together, it becomes clear that the swivelling first clamping jaw 4 is swivel-mounted through axis 9 on a slide 10 which is steplessly adjustable relative to the carrier 6. It further becomes clear that this slide 10 is disengageably fixable on the carrier 6 by clamping in any different position of travel. FIGS. 3 and 4 show the slide 10 jammed to the carrier 6.

In a manner yet to be described, the slide 10 consists essentially of two parts. FIGS. 1 and 3 to 5 show that the slide 10—with one of its parts—at least partially projects beyond the clamping jaw 4 swivel-mounted on it and does so spaced from the swivel axis 9 so as to form a lever arm and that an opening 11 for the wedge 8 is provided at this projecting area. This wedge 8 has its wedge face 8*a* applied to the swivelling clamping jaw 4, so that driving in the wedge 8 from the position depicted in FIG. 5 to a position in which the wedge enters the opening 11 to a greater depth, results in the movements wanted and particularly to the clamping or jamming and to the closing of the clamp 1. Instead of a wedge 8, provision might also be made in this area for an eccentric which acts upon the swivelling clamping jaw 4 relative to the slide 10 in an appropriate manner similarly to the arrangement of the wedge 8.

In the exemplary embodiment, the swivelling clamping jaw 4 takes the form of a double-armed lever whose one arm in the position of use transmits the clamping force. The other arm, as the actuating arm, projects beyond the swivel axis 9 to the opposite side, beyond the back 12 of the carrier 6, whereby the wedge 8—possibly an eccentric or similar adjusting element—is applied to this actuating arm in the manner shown particularly in FIGS. 1 and 2 to 4. This configuration of the swivelling clamping jaw 4 as a double armed lever, between whose two arms the swivel bearing is arranged with the aid of the swivel axis 9, hence means that a swivel movement of the clamping jaw 4 portion projecting beyond the back 12 of the carrier 6 results in an opposite swivel movement of the clamping jaw 4 portion presenting the clamping projection 4*a*. If a clamping force is to be exerted, the wedge 8 hence has to act upon the same side as that on which this clamping projection 4*a* protrudes from the clamping jaw 4.

Mention was already made that the slide 10 is essentially composed of two parts. In the exemplary embodiment it is contemplated that for this purpose the slide 10 has a guiding part 101 slidable on the carrier 6 and a holding part 102 capable of tipping or swivelling relative to this guiding part 101, which interconnected parts together compose the slide 10.

The holding part 102 engages over the carrier 6 on the front side 7 remote from the guiding part 101, which front side faces the formwork in the position of use and is the side on which the clamping jaws 4 and 5 project from the carrier 6, as is clearly shown in FIGS. 1 to 4. For this engagement over the front side 7 of the carrier 6, the slide 10, particularly its swivelling holding part 102, is provided with an abutment 13 which, when clamped, presses against the front side 7 of the carrier 6 according to FIGS. 3 and 4. Particularly according to FIG. 1, the distance between the guiding part 101 and the abutment 13 which belongs to the holding part 102 and engages over the front side 7 of the carrier 6 is greater than the cross-sectional size of the carrier 6 in this direction, whereby the greatest inner width between guiding part 101 and abutment 13 is meant. Therefore when the slide 10 is situated as depicted in FIG. 1, where it does not occupy its clamping position, it can be freely moved relative to the carrier 6. This simultaneously has the result that a swivel movement of the holding part 102 relative to the carrier 6 and thus also relative to the guiding part 101, as the slide 10 permits, leads to the abutment 13 bearing clampingly against the carrier 6 according to FIGS. 3 and 4.

Hence, the spacing between the face with which the guiding part 101 of the slide 10 acts upon the carrier 6, and the abutment 13 of the slide 10, is such that the slide 10 can be moved steplessly in the longitudinal direction of the carrier 6 without any difficulty. This leads to the clamping jaw 4 carried by this slide 10 being simultaneously moved to assume its position of use, before the clamp is then braced there.

It follows from FIG. 1 as well as from FIGS. 3 and 4 that the distance between the swivel axis 9 of the swivelling clamping jaw 4 on the holding part 102 and the abutment 13 of the adjustable slide 10 or, more specifically, the abutment 13 of the holding portion 102, is smaller than the distance between the swivel bearing 103 of the slide and the abutment 13, and that the wedge opening 11 is provided in the guiding part 101. By this means, it is possible for the holding part 102 of the slide 10 and the clamping jaw 4 to swivel with respect to each other and in opposite directions, as is to be seen particularly in FIGS. 3 and 4, whereby these two swivel movements can take place more or less simultaneously or slightly overlapping in time, when—after the swivelling clamping jaw 4 has been moved into the position shown in FIG. 1—the wedge 8 is driven into the wedge opening 11 to a greater depth and the clamping jaw 4 is thereby caused to swivel about its axis 9. This initially has the result that the force acting on the axis 9 swivels the slide into the position shown in FIG. 3 and simultaneously jams it, so that in the final clamping position of FIG. 4 the clamping force is transmitted from the wedge 8, through the slanted and thereby jammed slide 10 and particularly its holding part 102, to the clamping jaw 4 and thereby to the edge web 2, and an increase in the clamping force simultaneously leads also to an increase in the retention force of the slide 10 on the carrier 6.

This pendulum-like arrangement of the swivelling clamping jaw 4 on the holding part 102 of the slide 10 which is capable, in turn, of tipping about the swivel bearing 103, not only provides the possibility of steplessly adjusting the spacing of the two clamping jaws 4 and 5 for adaptation to different dimensions or spacings of edge webs 2. It also provides effective clamping and bracing of the clamping jaw 4 in its respective position of use, without need for elaborate additional clamping devices for fixing the slide 10. It hence proves to be advantageous for handling during the stepless adjustment and bracing of the clamp 1 that the swivelling clamping jaw 4 is not swivel-mounted on the carrier 6 itself, but is indirectly held by way of a holding part 102 of the slide 10 capable of tipping or swivelling relative to the carrier 6, and the jaw 4 is able to swivel relative thereto and thereby also relative to carrier 6.

Mention was already made that the wedge 8 is disposed and is movable in an opening 11 with a wedge-shaped taper in the guiding part 101 of the slide 10, so as to act upon the clamping jaw 4 at its swivel arm remote from the clamping point and to swivel the clamping jaw 4 about the axis 9, involving the already mentioned additional tipping and swivelling of the holding part 102 with the abutment 13. FIG. 5 shows that the cross section between the wedge faces of the wedge 8 and the longitudinal expanse of the generally slot-like opening 11 receiving the wedge 8 are oriented approximately parallel to the longitudinal expanse of the carrier 6 and, in the exemplary embodiment, outside the outline of the carrier 6 at the carrier back 12 remote from the clamping jaws 4 and 5. When the wedge 8 is driven deeper into the associated opening 11, this leads to the corresponding displacement of the actuating arm of the swivelling clamping jaw 4 on a circle arc whose tangent situated in this area is oriented in the same direction as, and parallel to, the carrier 6. The opposite swivel movements in the clamping area and at the holding part 102 of the slide, as were already mentioned several times, follow from this. At the same time, the wedge 8 is by this means placed at a location and oriented in a direction which does not lead to a large projection relative to the back of the formwork. Furthermore, the entire wedge 8 can be disposed and moved in a plane approximately parallel to the facing sheet.

It follows from FIGS. 2 and 5 in conjunction with FIGS. 1, 3 and 4 that the actuating arm or swivel arm of the swivelling clamping jaw 4 engages over the wedge opening 11 in a fork-like fashion over part of the length and the holding part 102 of the slide 10 embraces the carrier 6 on both sides and that the clamping jaw halves are journalled on the outer surfaces of the slide 10, one to each. In the exemplary embodiment, the clamping jaw halves are interconnected in the region outside the holding part 102 and guiding part 101 by way of a crosspiece or cross bolt 14 extending parallel to the abutment 13 of the holding part 102, parallel to the axis 9 and parallel to a further cross bolt 15 in the clamping zone of the swivelling clamping jaw 4. Hence, in a manner of speaking, the swivelling clamping jaw 4 is of two-piece design and has, in the space between its two parts, the slide 10 with the holding part 102 on the one hand and, within this holding part 102, the carrier 6 on the other. This results in a symmetrical transfer of forces from both clamping jaw parts to the slide 10, and vice versa, and a corresponding symmetrical introduction of the forces into the carrier 6. For lesser forces, it might also suffice, however, if one of the clamping jaw halves were to constitute the entire clamping jaw 4.

In FIG. 2 one can see that the carrier 6 has a T-shaped cross section, whereby the T-crosspiece 16 at the one end of this carrier 6 carries the stationary clamping jaw 5 and the swivelling clamping jaw 4 engages over both sides of this T-crosspiece 16. The guiding part 101 of the slide 10 engages the narrow side of the main web 17 of the T-section by means of a groove 18 receiving the edge of the main web 17, so that a guiding part 101 of relatively small width can be accommodated within the holding part 102. Nevertheless, great stiffness of the carrier 6 is obtained.

The already mentioned swivel bearing 103 of the holding part 102, with which the latter is capable of tipping or swivelling relative to the guiding part 101, is situated at an open-ended recess 19 of the guiding part 101 and takes the form of a bolt 20 which is inserted in this recess 19 and is connected to two cheeks of the holding part 102. The recess 19 is open towards the side facing away from the clamping jaws 4 and 5 and the bolt 20 extends transversely of the carrier 6, crosses the same in slightly spaced relationship to the back 12 of the carrier and is parallel to the axis 9. The slide 10 can therefore be put together very easily from the two parts substantially composing it. Nevertheless, in the assembled condition, disengagement of this joint formed by the swivel bearing 103 between guiding part 101 and 102 is not possible, because the distance between guiding part 101 and abutment 13 is not large enough to be able to remove the bolt 20 from the recess 19.

In order nevertheless to prevent inadvertent detachment of these parts, it is advantageous if, according to FIG. 5, the travel of the slide 10 and its guiding part 101 is limited by a projection 21 or an enlarged cross section at the end remote from the stationary clamping jaw 5. Hence the slide 10 cannot be drawn off the carrier 6 and be lost and neither can it fall apart at the swivel bearing 103 after sliding off the carrier 6 in such a way.

FIG. 5 further shows that the movement of the wedge 8 in the open position is also limited by a projection 22, whereby in FIG. 5 the wedge 8 has reached the maximum movement in the open position in which this projection 22 strikes against the guiding part 101. Therefore the wedge is also captive.

The clamp 1 serves for connecting form panels disposed in coplanar, side-by-side relation and for this purpose it engages their edge webs 2 or edge sections, which webs 2 can be directly adjacent to each other or have an intermediate piece located therebetween. For adaptation to varying spacings or for adaptation to different dimensions of edge webs 2 or edge sections, a first swivelling clamping jaw 4 is adapted to be adjusted steplessly relative to a stationary clamping jaw 5 and lengthwise of a carrier 6 supporting the two clamping jaws 4 and 5. In addition, the first swivelling clamping jaw 4 is swivel-mounted on a slide 10 which, in turn, can be fixed by clamping in any position on the carrier 6, particularly by a tipping or swivel movement in an opposite direction. Therefore the spacing between the clamping jaws 4 and 5 can be steplessly adjusted, without any measures for holding the swivel axis 9 of the swivelling clamping jaw 4 having to be taken on the carrier 6 itself, which would weaken the carrier 6.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A clamp (1) for connecting form panels which are disposed in coplanar, side-by-side relation and have edge webs (2) or edge sections along at least two confronting edges, the clamp comprising first and second clamping jaws (4, 5) adapted to be urged against oppositely directed longitudinal faces (3) of the edge webs or edge sections (2) to be fastened together, a carrier (6) connecting the clamping jaws (4, 5) and an actuating element for swivelling the first clamping jaw (4), the second clamping jaw (5) being permanently connected to the carrier (6) at a fixed angle and the first clamping jaw (4) being slidable relative to and in a longitudinal direction of the carrier (6), and in different positions of travel being swivelable about an axis (9) oriented transversely to the carrier (6) by one of a wedge (8), eccentric and adjusting element, the swivelling first clamping jaw (4) being swivel-mounted on a slide (10), the slide being movable on and steplessly adjustable relative to the carrier (6) and being the slide (10) is disengageably fixable on the carrier (6) by clamping in any position of travel.

2. A clamp as claimed in claim 1, wherein the slide (10) projects at least partially beyond the clamping jaw (4) swivel-mounted thereon at a location spaced from the swivel axis (9) to form a lever arm, and that one of an opening (11) for the wedge (8) and a bearing for the eccentric is provided in the projecting area, the one of the wedge (8), eccentric and the adjusting element having a wedge face or eccentric face which contacts the swivelling clamping jaw (4).

3. A clamp as claimed in claim 1, wherein a swivel bearing is located at the axis (9) and the swivelling clamping jaw (4) comprises of a double-armed lever having one arm which in an in-use position transmits a clamping force and another actuating arm which projects beyond the swivel bearing (9) toward an opposite side from the one arm, and the one of the wedge (8), the eccentric and the adjusting element is applied to said actuating arm.

4. A clamp as claimed in claim 1, wherein the slide (10) has a guiding part (101) slidable on the carrier (6), and a holding part (102) swivelable relative to the guiding part (101), the holding part (102) being engaged over the carrier (6) and including an abutment (13) on a side (7) of the carrier which is remote from the guiding part (101) and is on the which the clamping jaws (4,5) project from a distance between the guiding part (101) and the abutment (13) of the holding part (102) which engages over the carrier (6) is greater than a cross sectional size of the carrier (6) such that a swivel movement of the holding part (102) relative to the carrier (6) causes the abutment (13) to bear clampingly against the carrier (6).

5. A clamp as claimed in claim 4, wherein the distance between the swivel axis (9) of the swivelling clamping jaw (4) on the holding portion (102) and the abutment (13) of the adjustable slide (10) is smaller than the distance between a swivel bearing (20) located on the slide and the abutment (13), and one of a wedge opening (11) for the wedge or a bearing for the eccentric is provided on the guiding part (101).

6. A clamp as claimed in claim 4, wherein the wedge (8) is provided and is disposed and is movable in an opening (11) with a wedge-shaped taper in the guiding part (101) and the cross section between the wedge faces of the wedge (8) and the longitudinal expanse of the opening (11) receiving the wedge (8) are oriented approximately parallel to a longitudinal direction of the carrier (6), outside of an outline of the carrier (6) at backside (12) of the carrier remote from the clamping jaws (4, 5).

7. A clamp as claimed in claim 6, wherein the swivelling clamping jaw (4) includes a swivel arm which engages over the wedge opening (11) in a fork-like fashion over a partial length and the holding part (102) embraces the carrier (6) on both sides and the clamping jaw includes halves which are swivel-mounted on outer surfaces of the holding part (102), and the clamping jaw halves are interconnected in a region outside the holding part (102) by a crosspiece or cross bolt (14).

8. A clamp as claimed in claim 4, wherein the carrier (6) has a T-shaped cross section with a T-crosspiece (16) which carries the stationary clamping jaw (5), the swivelling clamping jaw (4) engages over the T-crosspiece, and the guiding part (101) includes a groove (18) which engages an edge of a narrow side of a main web (17) of the T-shaped cross section.

9. A clamp as claimed in claim 4, wherein the holding part (102) includes a swivel bearing (103) which is arranged at an open ended recess (19) on the guiding part (101) and takes the form of a bolt (20) inserted in the recess (19), the recess (19) is open towards a side facing away from the clamping jaws (4, 5) and the bolt (20) extends transversely to and crosses the carrier (6).

10. A clamp as claimed in claim 1, wherein the travel of the slide (10) or a guiding part (101) thereof is limited by one of a projection (22) and an enlarged cross section.

* * * * *